US007909236B2

(12) United States Patent
Erdie

(10) Patent No.: US 7,909,236 B2
(45) **Date of Patent: *Mar. 22, 2011**

(54) END CAPS FOR TUBES AND SHIPPING CONTAINERS FORMED THEREFROM

(75) Inventor: Jason S. Erdie, Richfield, OH (US)

(73) Assignee: Erdie End Caps, LLC, Lorain, OH (US)

( * ) Notice: Subject to any disclaimer, the term of this patent is extended or adjusted under 35 U.S.C. 154(b) by 1314 days.

This patent is subject to a terminal disclaimer.

(21) Appl. No.: 11/424,553

(22) Filed: Jun. 16, 2006

(65) Prior Publication Data

US 2007/0131738 A1 Jun. 14, 2007

Related U.S. Application Data

(63) Continuation-in-part of application No. 11/079,739, filed on Mar. 14, 2005, now Pat. No. 7,581,670, which is a continuation-in-part of application No. 10/801,786, filed on Mar. 16, 2004, now Pat. No. 7,296,730.

(51) Int. Cl.
*B65D 43/04* (2006.01)
*B65D 43/18* (2006.01)

(52) U.S. Cl. ..... 229/125.16; 220/281; 220/345.3; 220/787; 220/788; 220/789; 220/792; 220/794; 220/804; 220/806; 229/5.5; 229/125.17

(58) Field of Classification Search ..... 229/125.16, 229/125.17, 5.5, 93, 125.28; 220/787, 789, 220/792, 794, 801, 804, 806, 281, 297, 300, 786, 788, 345.3; 206/407, 415, 416
See application file for complete search history.

(56) References Cited

U.S. PATENT DOCUMENTS

| | | | | |
|---|---|---|---|---|
| 1,837,345 | A * | 12/1931 | Thomas | 220/804 |
| 2,734,762 | A * | 2/1956 | Aleck | 292/256.6 |
| 4,494,674 | A * | 1/1985 | Roof | 220/784 |
| 4,504,009 | A * | 3/1985 | Boik et al. | 229/5.5 |
| 5,435,455 | A * | 7/1995 | Pruss | 220/787 |
| 5,746,359 | A * | 5/1998 | Stanek et al. | 222/542 |
| 6,276,528 | B1 * | 8/2001 | Nowotny et al. | 220/8 |
| 6,913,165 | B2 * | 7/2005 | Linz et al. | 220/568 |
| 7,296,729 | B2 * | 11/2007 | Erdie | 229/125.17 |
| 7,296,730 | B2 * | 11/2007 | Erdie | 229/125.17 |
| 7,581,670 | B2 * | 9/2009 | Erdie | 229/5.5 |
| 7,581,671 | B2 * | 9/2009 | Erdie | 229/5.5 |
| 2007/0095838 | A1 * | 5/2007 | Roesler | 220/789 |

* cited by examiner

*Primary Examiner* — Gary E Elkins
(74) *Attorney, Agent, or Firm* — Rankin, Hill & Clark LLP

(57) ABSTRACT

An end cap adapted to releasably secure to a tube having a first open end to form a shipping container. The end cap includes a base, a sidewall surrounding and extending from the base, at least one movable projection biased to extend beyond the outer side of the sidewall, and a deformable sealing element extending from a perimeter of the base and/or from the outer side of the sidewall. When the end cap is secured to the tube, an inner side of tube surrounds the outer side of the sidewall of the end cap, the movable projection extends into a mounting opening formed in the tube proximal to the first open end, and the sealing element is deformed against the inner side of the tube to form a circumferential seal between the end cap and the tube such that the end cap completely plugs a passageway through the tube.

16 Claims, 6 Drawing Sheets

FIG. 1
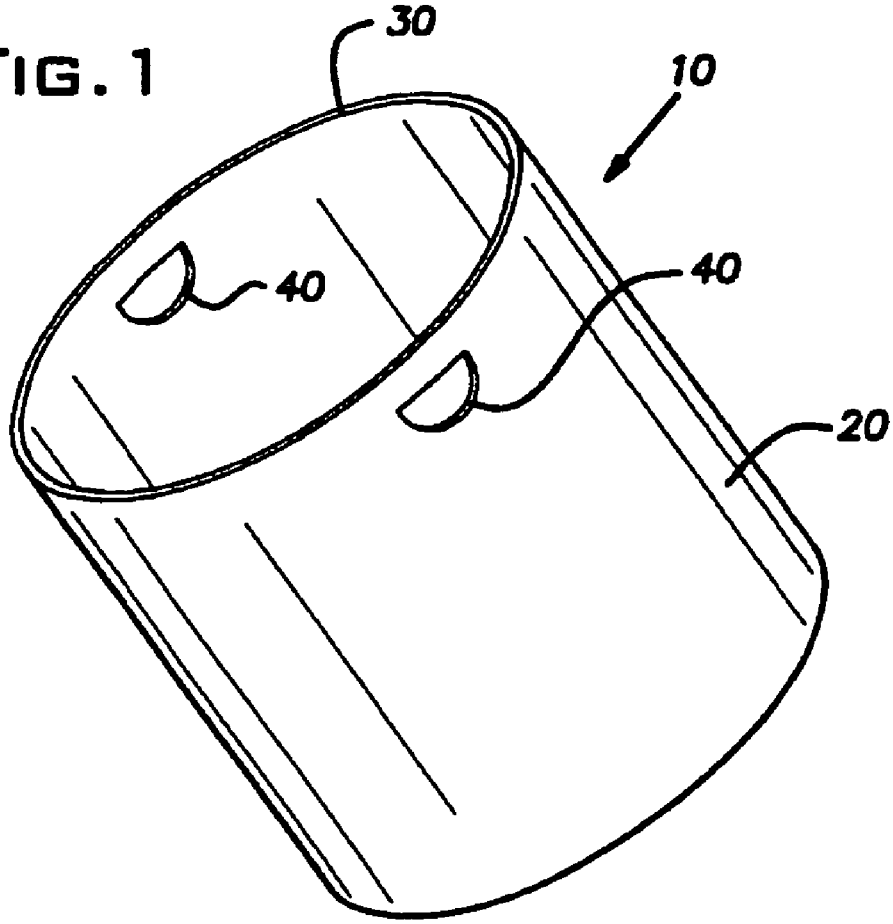
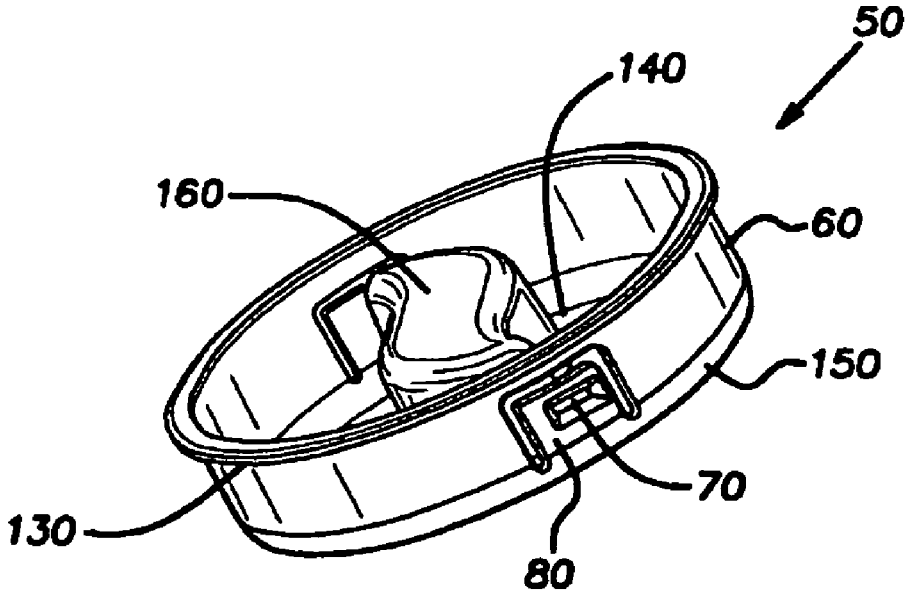
FIG. 2

Fig.5
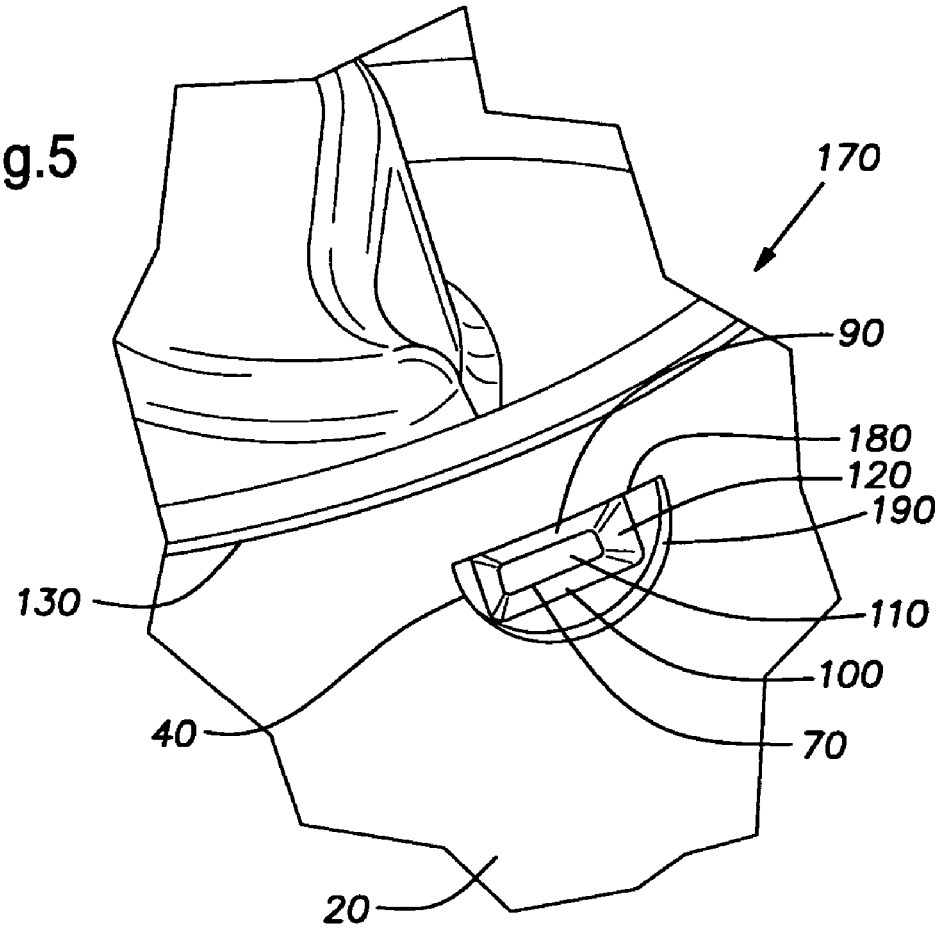
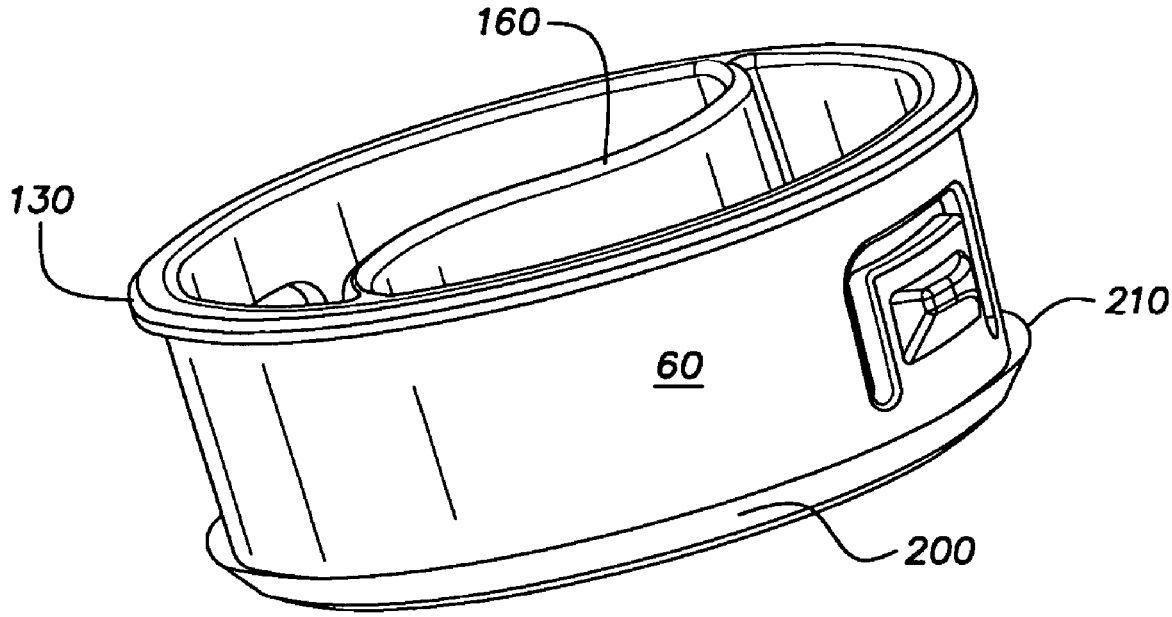
Fig.6

Fig.7
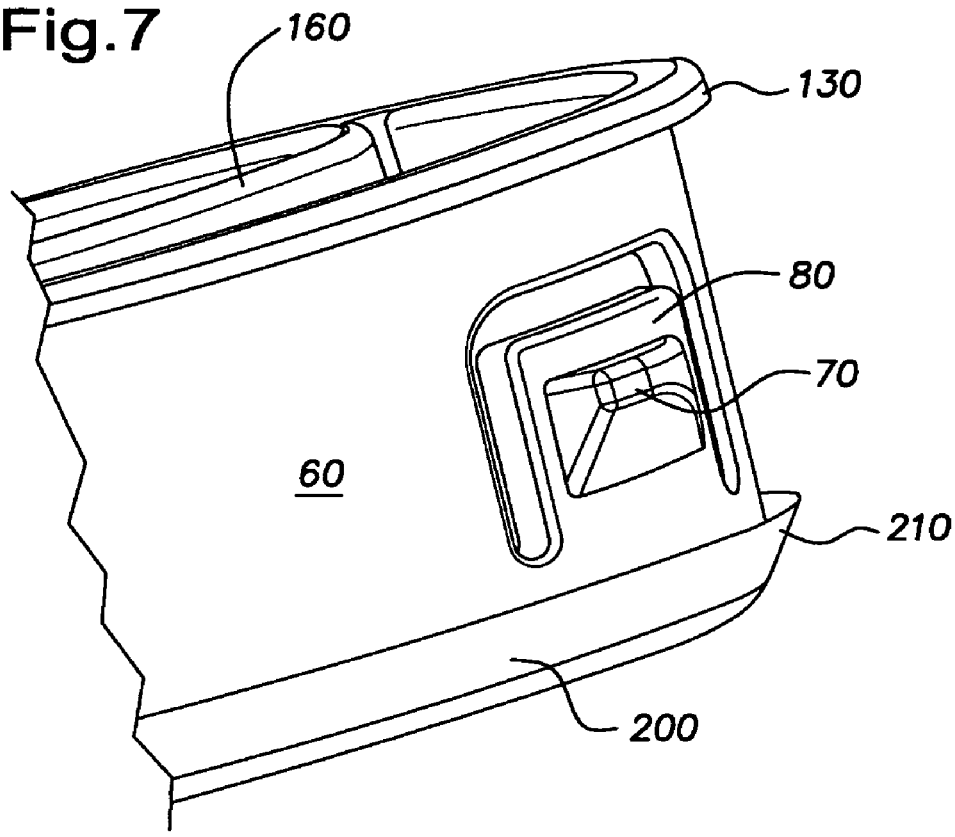
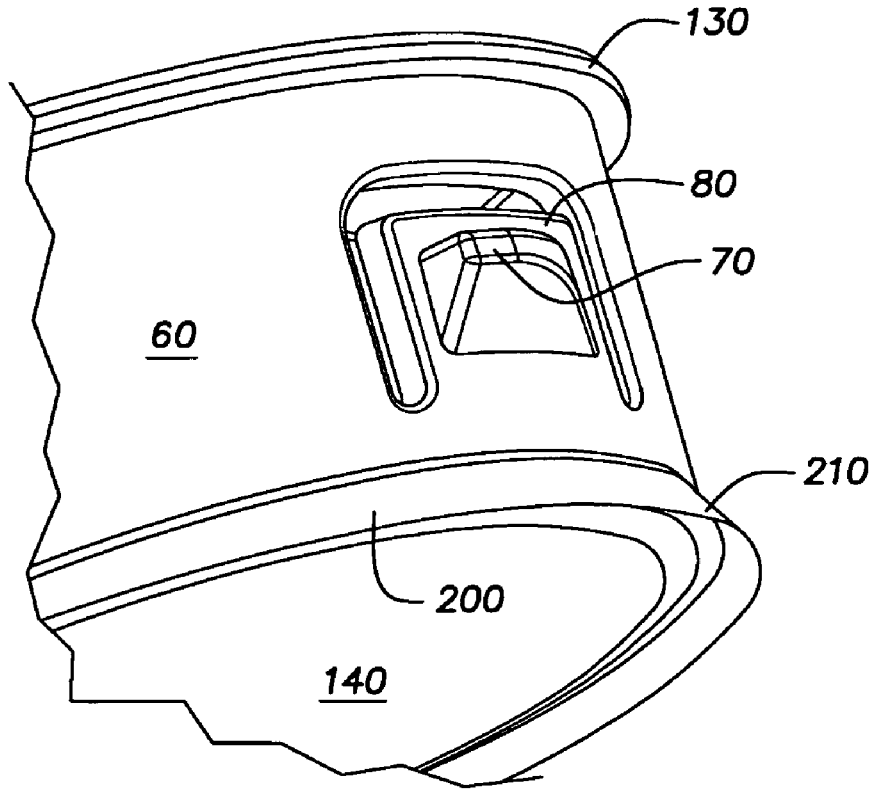
Fig.8

Fig.9
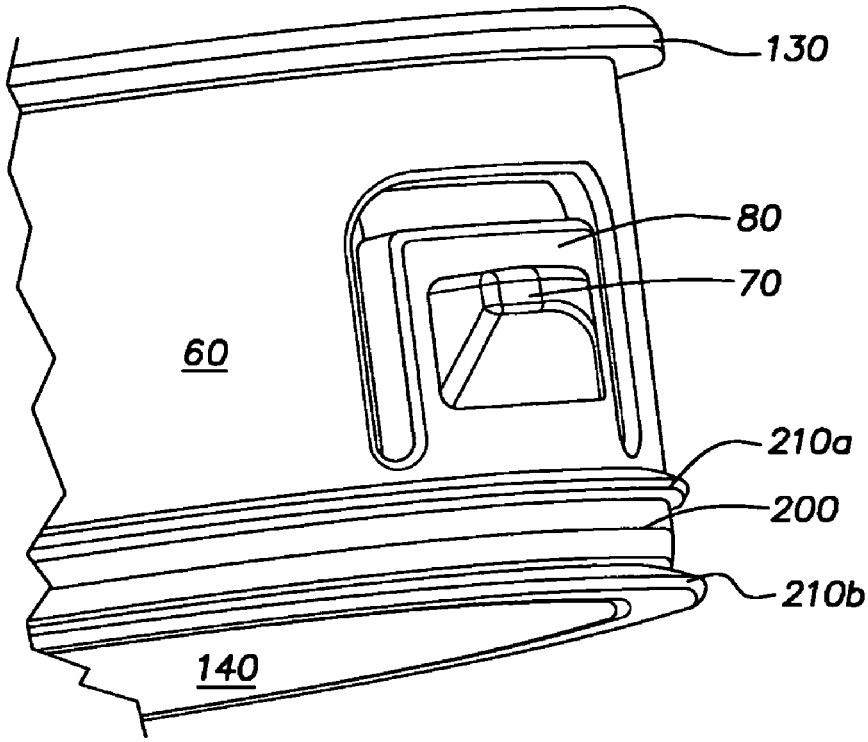
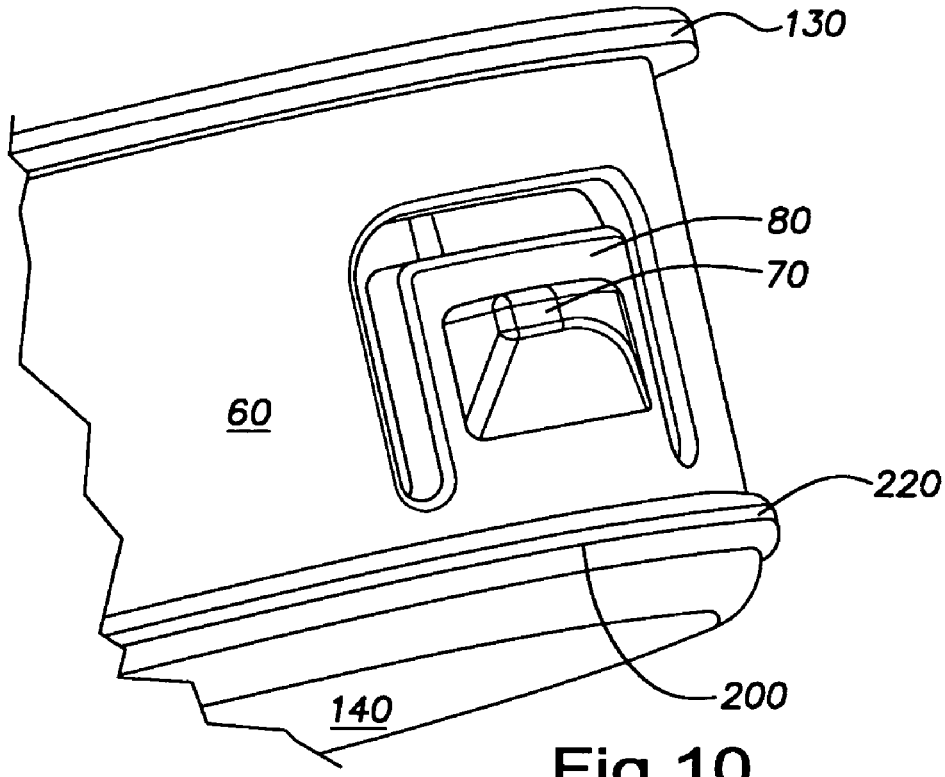
Fig.10

Fig.11
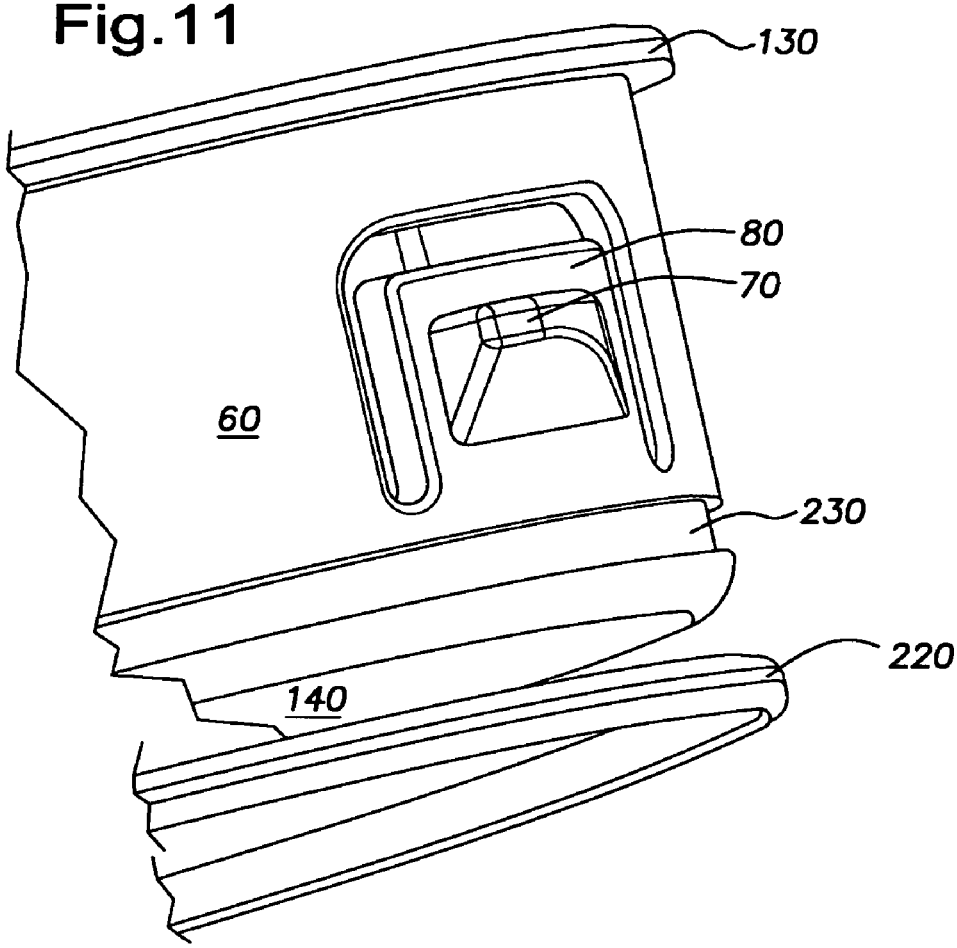
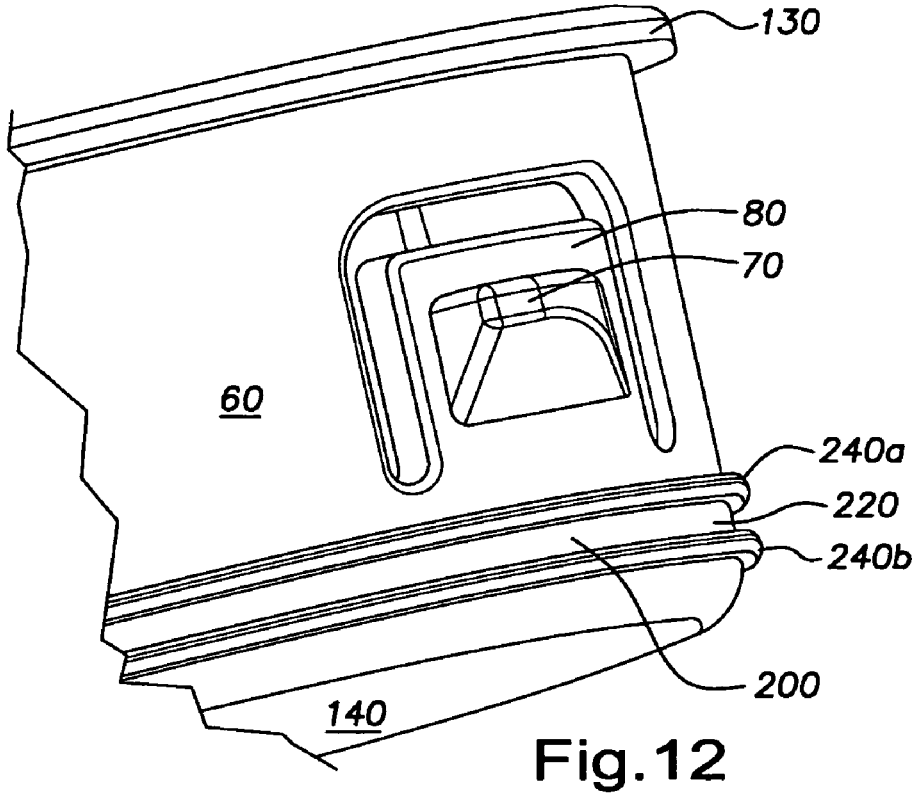
Fig.12

END CAPS FOR TUBES AND SHIPPING CONTAINERS FORMED THEREFROM

CROSS REFERENCE TO RELATED APPLICATIONS

The present application is a continuation-in-part of U.S. Ser. No. 11/079,739, filed Mar. 14, 2005, which is a continuation-in-part of U.S. Ser. No. 10/801,786, filed Mar. 16, 2004.

BACKGROUND OF THE INVENTION

1. Field of Invention

The present invention relates to an end caps that can be releasably secured to tubes, and shipping containers formed therefrom.

2. Description of Related Art

In co-pending U.S. Ser. Nos. 10/801,786 and 11/079,739, both of which are hereby incorporated by reference in their entirety, the applicant herein disclosed several embodiments of end caps that were adapted to releasably secure to tubes to form shipping containers. In one such embodiment, the end cap included a sidewall that was adapted to be received within an open end of the tube such that an inner side of the tube was surrounded the sidewall of the end cap. The sidewall of the end cap included at least one projection biased on a deflectable tab portion of the sidewall to extend away from the sidewall into a mounting opening formed in the tube proximal to the open end. This arrangement advantageously inhibits the end cap from inadvertently becoming dislodged from the tube. It also allows the end cap to be removed simply by rotating the end cap relative to the tube until the projection is no longer extending into the mounting opening and then withdrawing the end cap from the tube.

Although the various embodiments of end caps and shipping containers disclosed in co-pending U.S. Ser. Nos. 10/801,786 and 11/079,739 provide many advantages over the prior art, there is still additional room for improvement. For example, in the embodiment previously described above, the outer diameter of the sidewall must be smaller than (or about the same as) the inner diameter of the tube because the sidewall of the end cap must be received within the open end of the tube such that the inner side of the tube is surrounded the sidewall of the end cap. This means that there may be gaps between the outer side of the sidewall and the inner side of the tube that can allow air and moisture to infiltrate the shipping container.

SUMMARY OF THE INVENTION

The present invention provides end caps that are adapted to releasably secure to a first open end of a tube, and shipping containers therefrom. The end caps according to the invention include a deformable sealing element becomes deformed against an inner side of the tube when the end cap is disposed within the tube. The sealing element forms a circumferential seal between the end cap and the tube such that the end cap completely plugs a passageway through the tube. The circumferential seal between the end cap and the tube substantially inhibits air and water infiltration into and out of the shipping container.

More particularly, an end cap according to the present invention comprises a base, a sidewall surrounding and extending from the base, at least one movable projection biased to extend beyond the outer side of the sidewall, and a deformable sealing element extending from a perimeter of the base and/or from the outer side of the sidewall. When the end cap is secured to the tube, an inner side of tube surrounds the outer side of the sidewall of the end cap, the movable projection extends into a mounting opening formed in the tube proximal to the first open end, and the sealing element is deformed against the inner side of the tube to form a circumferential seal between the end cap and the tube such that the end cap completely plugs a passageway through the tube.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWINGS

FIG. 1 is a perspective view of a portion of a tube showing mounting openings formed proximal to an open end.

FIG. 2 is a previously disclosed embodiment of an end cap for releasable engagement with the paper tube shown in FIG. 1.

FIG. 5 is a detailed perspective view of a portion of the shipping container shown in FIG. 4.

FIG. 6 is a perspective view of one embodiment of an end cap according to the present invention.

FIG. 7 is a detailed perspective view of a portion of the end cap shown in FIG. 6.

FIG. 8 is a detailed perspective view of a portion of another embodiment of an end cap according to the present invention.

FIG. 9 is a detailed perspective view of a portion of yet another embodiment of an end cap according to the present invention.

FIG. 10 is a detailed perspective view of a portion of yet another embodiment of an end cap according to the present invention.

FIG. 11 is a detailed perspective view of a portion of the end cap shown in FIG. 10 with the O-ring removed.

FIG. 12 is a detailed perspective view of a portion of yet another embodiment of an end cap according to the present invention.

DETAILED DESCRIPTION OF THE PREFERRED EMBODIMENTS

Figure 3:
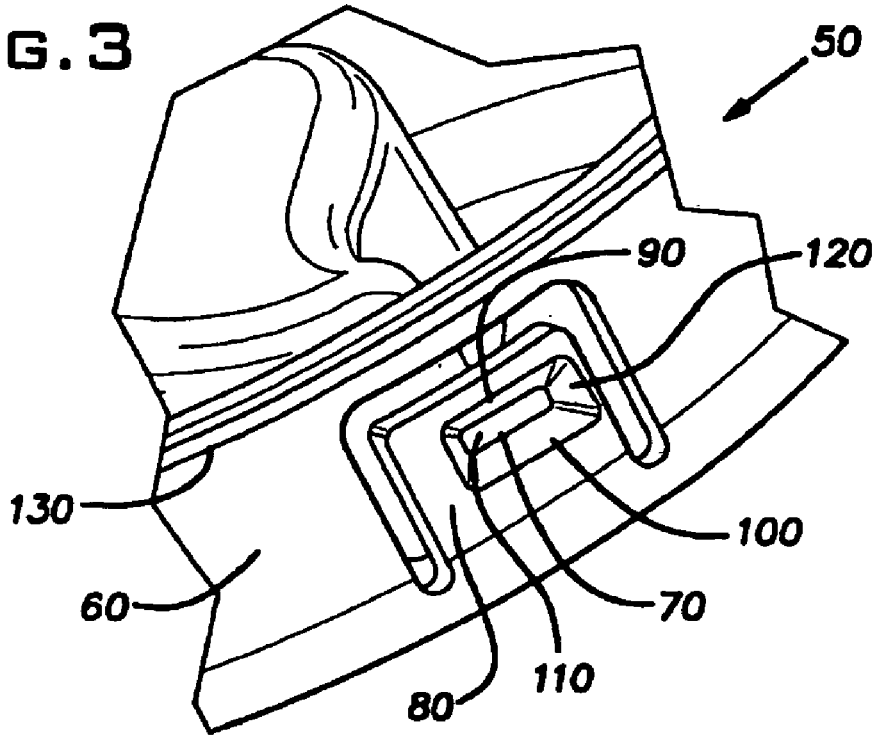
FIG. 3 is a detailed perspective view of a portion of the end cap shown in FIG. 2.

A perspective view of a portion of a tube 10 is shown in FIG. 1. The tube 10 comprises a cylindrical body 20 having at least one open end 30. At least one or, more preferably, a plurality of mounting opening 40 are formed in the cylindrical body 20 adjacent to the open end 30. The mounting openings can have any shape. Preferably, a plurality of mounting openings 40 are spaced an equal distance apart radially about the cylindrical body 20 adjacent to the open end 30. The tube 10 can be of any size and can be provided with as many or as few mounting openings 40 as desired. Tubes 10 having an inner diameter of about four inches or less are preferably provided with at least two, and more preferably, three or more mounting openings 40.

The tube 10 can be formed of plastic or paper using conventional tube manufacturing techniques. The mounting holes 40 can be formed by cutting, punching or by other forming means. When the tube is made of paper, the wall thickness of the cylindrical body 20 is preferably within the range of from about 0.050 inches to about 0.250 inches, with wall thicknesses of 0.070 inches to about 0.125 inches being most preferred. The cylindrical body 20 can be of any desired length.

A perspective view of one embodiment of an end cap 50 such as previously disclosed in applicant's co-pending applications is shown in FIG. 2. In this embodiment, the end cap 50 comprises a sidewall 60 and at least one or, more preferably, a plurality of projections 70 that extend or project outwardly away from the sidewall 60.

With reference to FIG. 3, which shows a detailed perspective view of a portion of the end cap 50 shown in FIG. 2, each projection 70 is preferably formed on a deflectable tab portion 80 of the sidewall 60. The shape and orientation of the deflectable tab portion 80 is not critical, and a variety of shapes or configurations can be used. However, the deflectable tab portion 80 should be sized and configured to facilitate sufficient inward deflection of the tab portion 80 that a top edge portion 90 of the projection 70 does not extend beyond the sidewall 60 of the end cap 50. This is necessary in order to facilitate removal of the end cap 50 from the tube 10.

As is shown in FIG. 3, the projection 70 also preferably comprises a bottom ramp portion 100 arranged on a side opposite the top edge portion 90. The bottom ramp portion 100 preferably provides a gradual or angled approach from the sidewall 60 to a tip 110 or farthest point of the projection 70. The bottom ramp portion 100 promotes inward deflection of the deflectable tab portion 80 when the end cap 50 is pressed into the open end 30 of the tube 10.

The projection 70 also preferably comprises a side ramp portion 120 that is arranged on or both sides of the projection 70 between the top edge portion 90 and the bottom ramp portion 100. Like the bottom ramp portion 100, the side ramp portion 120 provides a gradual or angled approach from the sidewall 60 to a tip 110 or farthest point of the projection 70.

It will be appreciated that the shape of the projection 70 is not per se critical, and that rounded "bumps" with a generally flat top edge portion 90 or other shapes could be used. It will also be appreciated that the deflectable tab portion 80 and the projection 70 can be coextensive. It is important, however, that the top edge portion 90 of the projection 70 be able to contact the top peripheral edge 180 (see FIG. 5) of the mounting opening 40 to prevent the removal of the end cap 50 from the tube 10, and that the projection 70 be able to be positioned (by rotation) such that it no longer projects into the mounting opening 40.

The end cap 50 also preferably comprises a peripheral rim portion 130 that extends beyond the sidewall 60. The peripheral rim portion 130 extending beyond the sidewall 60 will contact a perimeter edge of the open end 30 of the tube 10 thus limiting the extent to which the end cap 50 can be received within the open end 30 of the tube 10. This advantageously prevents the end cap 50 from being pushed too far into the tube 10, past the point where the projection(s) 70 would be aligned with the mounting opening(s) 40.

The end cap 50 also comprises a base 140 that is surrounded by and extends between the sidewall 60. The base 140 can extend between the sidewall 60 at any point (i.e., at the bottom or at the top or at any point in between), but is preferably nearer to a lower or bottom portion 150 of the sidewall 60 below the deflectable tab portion 80. In FIG. 2, the base 140 extends from the lower or bottom portion 150 of the sidewall 60.

Preferably, the base 140 further comprises a handle portion 160 for facilitating rotation of the end cap 50 relative to the tube 10. The shape and configuration of the handle portion 160 is not critical, but should provide a comfortable gripping surface for one's fingers.

The end cap is preferably formed of a plastic material such as polystyrene, polyethylene, polypropylene, nylon and/or one or more other thermoplastic or thermosetting polymers. The end cap can be formed using conventional molding or fabricating processes and equipment.

Figure 4:
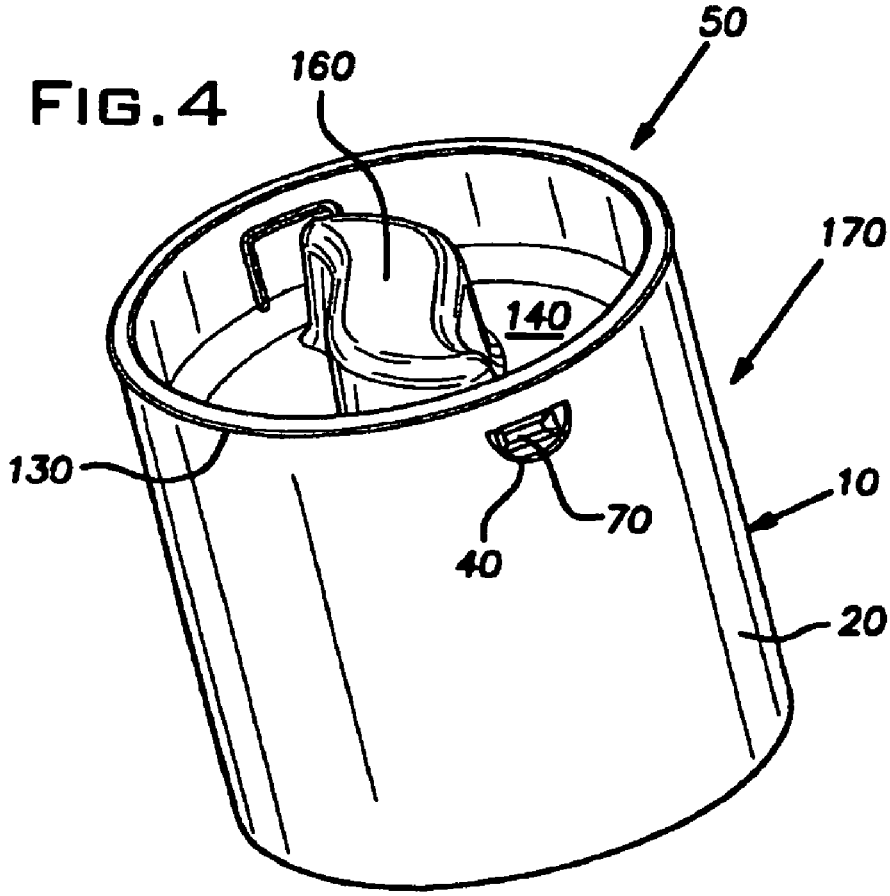
FIG. 4 is a perspective view of the end cap shown in FIG. 2 secured to the tube shown in FIG. 1 to form a shipping container.

FIG. 4 shows a perspective view of a shipping container 170 that can be formed by joining a tube 10 such as shown in FIG. 1 and an end cap 50 such as shown in FIG. 2 together. As shown in FIG. 4., the end cap 50 closes off the open end 30 of the tube 10. The end cap 50 is received within the open end 30 of the tube 10 such that the cylindrical body 20 radially surrounds the sidewall 60 of the end cap 50. At least one projection 70 extends away from the sidewall 60 and into a mounting opening 40 so as to releasably secure the end cap 50 to the tube 10.

With reference to FIG. 5, which shows a detailed perspective view of a portion of the shipping container 170 shown in FIG. 4, the top edge portion 90 of the projection 70 is arranged to contact against a top peripheral portion 180 of the mounting opening 40 to thereby prevent withdrawal of the end cap 50 from the tube 10. Rotation of the end cap 50 relative to the tube 10, however, causes the side ramp portion 120 to contact a side peripheral portion 190 of the mounting opening 40, which causes inward deflection of the deflectable tab portion 80 sufficient to prevent engagement or contact between the top edge portion 90 and the top peripheral portion 180 of the mounting opening 40. Once the projection 70 is no longer aligned with and extending into the mounting opening 40, the end cap 50 can simply be withdrawn or pulled from the open end 30 of the tube 10.

With reference to FIGS. 6-12, end caps 50 according to the present invention comprise a base 140, a sidewall 60 surrounding and extending from the base 140, at least one movable projection 70 biased to extend beyond the outer side of the sidewall 60, and a deformable sealing element 200 that extends from a perimeter of the base 140 and/or from the outer side of the sidewall 60. When the end cap 50 according to the present invention is secured to the tube 10, an inner side of tube 10 surrounds the outer side of the sidewall 60 of the end cap 50, the movable projection 70 extends into a mounting opening 40 formed in the tube 10 proximal to the first open end 30, and the sealing element 200 is deformed against an inner side of the tube 10 to form a circumferential seal between the end cap 50 and the tube 10 such that the end cap 50 completely plugs a passageway through the tube 10.

In the embodiment of the end cap according to the invention shown in FIGS. 6 and 7, the sealing element 200 comprises a fin 210 that extends from the perimeter of the base 140 at or very near where the outer side of the sidewall 60 meets the base 140. It will be appreciated that the sealing element 200 can extend from the base 140 and/or from the outer side of the sidewall 60. The fin 210 can extend generally perpendicular from the sidewall 60 or generally parallel to the base 140, or it can extend away from the base 140 and/or sidewall 60 at an angle. The fin 210 shown in FIGS. 6 and 7 is angled toward the rim portion 130 of the end cap 50. FIG. 8 shows an alternative embodiment in which the fin 210 is angled away from the rim portion 130 of the end cap 50.

The sealing element must extend beyond the outer side of the sidewall 60 of the end cap 50 a distance sufficient that it can make contact with the inner side or surface of the tube 10 when the end cap 50 is pressed into the tube 10, base 140 first. The outer peripheral portion of the sealing element 200 is preferably circular in shape, but may have a shape other than that of a circle provided it can deform to form a seal against the inner side of the tube 10.

FIG. 9 shows another embodiment of an end cap 50 according to the invention in which the sealing element 200 comprises two spaced apart fins 210*a* and 210*b*, one (210*a*) extending from the outer side of the sidewall 60 and one (210*b*) extending from the perimeter of the base 140. It will be appreciated that the sealing element 200 can include a plurality of fins 210, which may extend from the outer side of the sidewall 60 and/or the base 140 at any angle.

In the embodiments of end caps 50 according to the invention shown in FIGS. 6-9, the fin 210 or fins 210*a*, 210*b* are formed integrally with the base 140 and/or sidewall 60 of the end cap 50 from which the fin 210 or fins 210*a*, 210*b* extend. The end caps 50 are preferably formed of a plastic material, and thus in these embodiments, the fin 210 or fins 210*a*, 210*b* are also preferably formed of plastic. In order to allow the fin 210 or fins 210*a*, 210*b* to deform and form a good seal between the end cap 50 and the inner side of the tube 10, it may be necessary for the fin 210 or fins 210*a*, 210*b* to have a tapered cross section, with the thickest dimension being proximal to the outer side of the sidewall and/or base, and the thinnest dimension being distal to thereto.

FIGS. 10 and 11 show an end cap 50 according to yet another embodiment of the present invention. In the embodiment illustrated in FIGS. 10 and 11, the deformable sealing element 200 comprises an elastomeric O-ring 220 that is received in a groove 230 or a channel formed on the outer side of the sidewall 60. The elastomeric O-ring 220 is preferably formed of natural rubber or a synthetic elastomer material. When an end cap 50 such as shown in FIGS. 10 and 11 is inserted into a tube 10, base 140 first, the O-ring 220 is compressed against the inner side of the tube 10 an thus forms a circumferential seal between the end cap 50 and tube 10 that inhibits the infiltration of air and water into or out of the tube 10 around the end cap 50.

FIG. 12 shows yet another embodiment of an end cap 50 according to the invention. In the embodiment shown in FIG. 12, the elastomeric O-ring 220 comprises a plurality of spaced apart circumferential beads 240*a*, 240*b*. The beads 240*a*, 240*b* compress and/or otherwise deform against the inner side of the tube 10 when the end cap 50 is inserted, base 140 first, into the tube 10. An O-ring 220 having a pair (or more than a pair) of spaced apart circumferential beads 240*a*, 240*b* is believed to form a better seal between the end cap 50 and the tube 10 than an O-ring 220 having no bead 240 or only one bead 240.

End caps according to the present invention may include the same features and elements (e.g., lock members, polygonal peripheral rim portions etc.) as the end caps disclosed in applicant's co-pending U.S. Ser. Nos. 10/801,786 and 11/079,739, which have been incorporated by reference in their entirety. In the presently most preferred embodiment of the invention, an end cap according to the invention comprises a plurality of movable projections biased to extend beyond the outer side of the sidewall such that when the end cap is secured to a tube, each one of the plurality of movable projections extends into one of a plurality of mounting openings spaced radially about the tube proximal to the first open end. Preferably, each of the plurality of projections extends from a deflectable tab portion of the sidewall. Furthermore, for the reasons explained in the co-pending applications, each of the plurality of projections preferably comprises a side ramp portion for contacting an edge of the mounting opening into which the projection extends when the end cap is rotated relative to the tube to promote inward deflection of the tab portion until the projection no longer extends into the mounting opening thus allowing the end cap to be removed from the tube.

The end caps according to the present invention are particularly useful for closing an open end of a tube that is to be used a shipping container. An end cap according to the invention can be securely attached to a tube quickly and without the need for special tooling, and can be removed by hand with relative ease. The end caps of shipping tubes formed in accordance with the invention are significantly more difficult to unintentionally dislodge from an open end of a tube as compared to conventional plastic plugs or other tube end closures.

A shipping container according to the invention thus comprises a tube and at least one end cap according to the invention. It will be appreciated that an end cap according to the invention can be applied to both ends of the tube or simply one end. The tube of the shipping container according to the invention comprises a cylindrical body having an inner side and an inner diameter D1, a first open end, and at least one mounting opening formed in the cylindrical body proximal to the first open end. The end cap of the shipping container according to the invention, as noted above, is removably securable to the tube and comprises a base, a sidewall surrounding and extending from the base, the sidewall having an outer side having an outer diameter D2 that is less than or equal to the inner diameter D1 of the cylindrical body of the tube, at least one movable projection biased to extend beyond the outer side of the sidewall, and a deformable sealing element extending from a perimeter of the base and/or from the outer side of the sidewall. When the end cap is secured to the tube, the inner side of the cylindrical body surrounds the outer side of the sidewall of the end cap, the movable projection extends into the mounting opening formed in the cylindrical body of the tube proximal to the first open end, and the sealing element is deformed against the inner side of the tube to form a circumferential seal between the end cap and the tube such that the end cap completely plugs a passageway through the tube.

In one preferred embodiment, a shipping container according to the invention comprises an end cap made of plastic and a tube made of paper. In another preferred embodiment, a shipping container according to the invention comprises an end cap made of plastic and a tube that is also made of plastic. The plastic used to manufacture the end cap and/or the tube can be opaque, translucent or transparent. Semi-transparent plastic tubes with opaque plastic end caps make excellent shipping containers. The semi-transparent plastic tubes allow one to rapidly visually determine whether an object is stored within the tube or not. Furthermore, the end caps can be color coded to help identify the contents of the container.

The peripheral edge portion of the rim portion of the end caps used in shipping containers according to the invention preferably define a polygonal shape, such as a triangle, which makes tube less likely to roll. This helps keep the tube on conveyor belting used in package distribution centers.

The sealing element is preferably disposed nearer the base than the deflectable tab portion of the sidewall of the end cap. Thus, when the end cap is pressed into a tube, the circumferential seal formed between the end cap and the inner side or wall of the tube together with the base (and a portion of the sidewall below the sealing element, if the sealing element extends from the sidewall) form a plug that inhibits the infiltration of water and air into and out of the container. This seal is particularly strong when the sealing element is formed of an elastomeric material and the tube is formed of plastic.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An end cap adapted to releasably secure to a tube having a first open end and a plurality of mounting openings formed in the tube proximal to the first open end, the end cap comprising:

a base, a sidewall surrounding and extending from the base, a plurality of movable projections, each of the movable projections being formed on a deflectable tab portion of the sidewall and being biased to extend beyond an outer side of the sidewall, and a deformable sealing element extending from a perimeter of the base and/or from the outer side of the sidewall, wherein the end cap is adapted to be secured to the tube such that an inner side of the tube surrounds the outer side of the sidewall of the end cap, each one of the plurality of movable projections extends into one of the plurality of mounting openings formed in the tube proximal to the first open end, and the deformable sealing element is deformed against an inner side of the tube to form a circumferential seal between the end cap and the tube such that the end cap completely plugs a passageway through the tube, and wherein each of the plurality of movable projections further comprises a side ramp portion for contacting an edge of the mounting opening into which the movable projection extends when the end cap is rotated relative to the tube to promote inward deflection of the tab portion until the projection no longer extends into the mounting opening thus allowing the end cap to be removed from the tube.

2. The end cap according to claim 1 wherein the deformable sealing element comprises a fin that extends from the perimeter of the base and/or from the outer side of the sidewall.

3. The end cap according to claim 2 wherein the fin is formed of plastic and is formed integrally with the base and/or sidewall of the end cap from which it extends.

4. The end cap according to claim 1 wherein the deformable sealing element comprises a plurality of spaced apart fins that extend from the perimeter of the base and/or from the outer side of the sidewall.

5. The end cap according to claim 1 wherein the deformable sealing element comprises an elastomeric O-ring that is received in a groove or a channel formed on the outer side of the sidewall.

6. The end cap according to claim 5 wherein the elastomeric O-ring comprises a plurality of spaced apart circumferential beads.

7. The end cap according to claim 1 wherein the end cap further comprises a peripheral rim portion that extends beyond the sidewall for contacting a perimeter of the first open end of the tube to limit the extent to which the end cap can be received within the first open end of the tube.

8. A shipping container comprising:

a tube comprising:

a cylindrical body having an inner side and an inner diameter D1, a first open end, and a plurality of mounting openings formed in the cylindrical body proximal to the first open end; and an end cap that is removably securable to the tube, the end cap comprising:

a base, a sidewall surrounding and extending from the base, the sidewall having an outer side having an outer diameter D2 that is less than or equal to the inner diameter D1 of the cylindrical body of the tube, a plurality of movable projections, each of the movable projections being formed on a deflectable tab portion of the sidewall and being biased to extend beyond the outer side of the sidewall, and a deformable sealing element extending from a perimeter of the base and/or from the outer side of the sidewall, wherein, when the end cap is secured to the tube, the inner side of the cylindrical body surrounds the outer side of the sidewall of the end cap, each one of the plurality of movable projections extends into one of the plurality of mounting openings formed in the cylindrical body of the tube proximal to the first open end, and the deformable sealing element is deformed against the inner side of the tube to form a circumferential seal between the end cap and the tube such that the end cap completely plugs a passageway through the tube, and wherein each of the plurality of movable projections comprises a side ramp portion for contacting an edge of the mounting opening into which the movable projection extends when the end cap is secured to the tube thereby promoting inward deflection of the deflectable tab portion when the end cap is rotated relative to the tube and thus allowing the end cap to be withdrawn from the first open end of the tube.

9. The shipping container according to claim 8 wherein the deformable sealing element comprises a fin that extends from the perimeter of the base and/or from the outer side of the sidewall.

10. The shipping container according to claim 8 wherein the fin is formed of plastic and is formed integrally with the base and/or sidewall of the end cap.

11. The shipping container according to claim 8 wherein the deformable sealing element comprises a plurality of spaced apart fins that extend from the perimeter of the base and/or from the outer side of the sidewall.

12. The shipping container according to claim 8 wherein the deformable sealing element comprises an elastomeric O-ring that is received in a groove or a channel on the outer side of the sidewall.

13. The shipping container according to claim 12 wherein the elastomeric O-ring comprises one or more circumferential beads having an outer perimeter that defines a circle having a diameter D3 that is larger than the inner diameter D1 of the tubular body.

14. The shipping container according to claim 8 wherein the end cap further comprises a peripheral rim portion that extends beyond the sidewall, the peripheral rim portion contacting a perimeter of the first open end of the tube to limit the extent to which the end cap can be received within the first open end of the tube.

15. The shipping container according to claim 8 wherein the end cap is made of plastic and the tube is made of paper.

16. The shipping container according to claim 8 wherein the end cap and the tube are both made of plastic.

* * * * *